US007233753B2

(12) United States Patent
Choi

(10) Patent No.: US 7,233,753 B2
(45) Date of Patent: Jun. 19, 2007

(54) TONER CARTRIDGE AND METHOD OF ATTACHED GUIDE MEMBER THEREIN

(75) Inventor: Sam-seok Choi, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 248 days.

(21) Appl. No.: 10/896,945

(22) Filed: Jul. 23, 2004

(65) Prior Publication Data

US 2005/0084298 A1 Apr. 21, 2005

(30) Foreign Application Priority Data

Oct. 18, 2003 (KR) ..... 10-2003-0072798

(51) Int. Cl.
*G03G 15/08* (2006.01)

(52) U.S. Cl. ..... 399/119; 399/284

(58) Field of Classification Search ..... 399/103, 399/105, 106, 107, 119, 273, 274, 283, 284; 264/229, DIG. 76; 29/446, 449, 452, 453
See application file for complete search history.

(56) References Cited

U.S. PATENT DOCUMENTS 5,134,441 A * 7/1992 Nagata et al. ..... 399/103
5,642,186 A * 6/1997 Michlin et al. ..... 399/107
5,845,182 A * 12/1998 Johroku et al. ..... 399/256
5,923,931 A * 7/1999 Kishimoto ..... 399/256
6,212,343 B1 * 4/2001 Hosokawa et al. ..... 399/102
6,868,239 B2 * 3/2005 Inoue et al. ..... 399/27

FOREIGN PATENT DOCUMENTS

| | | | |
|---|---|---|---|
| JP | 60051854 A | * | 3/1985 |
| JP | 05019550 A | * | 1/1993 |
| JP | 6-258878 | | 9/1994 |
| JP | 9-114275 | | 5/1997 |
| JP | 10-254256 | | 9/1998 |
| JP | 2000-132059 | | 5/2000 |
| JP | 2003-84647 | | 3/2003 |

* cited by examiner

*Primary Examiner*—Robert Beatty
(74) *Attorney, Agent, or Firm*—Stanzione & Kim, LLP

(57) ABSTRACT

A toner cartridge including a guide member that guides supplying operation of toner. The toner cartridge includes a housing, in which a toner of a predetermined color is filled, a first coupling portion and a second coupling portion within the housing that are formed at predetermined positions of an inner wall of the housing; a developing roller, part of which is exposed outside of the housing, installed rotatably on the housing to supply the toner to a photosensitive medium and to develop an image; a supplying roller that attaches the toner to the developing roller; and the guide member that guides the toner supply and is coupled to the first and second coupling portions. Both ends of the guide member are coupled to the first and second coupling portions such that the guide member is flexed when being installed in the housing.

27 Claims, 4 Drawing Sheets

TONER CARTRIDGE AND METHOD OF ATTACHED GUIDE MEMBER THEREIN

CROSS-REFERENCE TO RELATED APPLICATIONS

This application claims the priority of Korean Patent Application No. 2003-72798, filed on Oct. 18, 2003, in the Korean Intellectual Property Office, the disclosure of which is incorporated herein in its entirety by reference.

BACKGROUND OF THE INVENTION

1. Field of the Invention

The present general inventive concept relates to a toner cartridge supplying toner to an electrophotographic printer, and more particularly, to a toner cartridge having an improved guide member, which guides the toner supply.

2. Description of the Related Art

In general, an electrophotographic printer is an apparatus that forms an electrostatic latent image by scanning light onto a photosensitive medium which is charged to a predetermined electric potential, develops the image with a toner of a predetermined color, and transfers and fuses the developed image on a sheet of paper.

The electrophotographic printers can be classified into a liquid type electrophotographic printer and a dry type electrophotographic printer according to the type of developer. The liquid type electrophotographic printer uses a developer in which a liquid carrier includes distributed powder toner. The dry type electrophotographic printer uses a binary developer including a powder type carrier and a toner or a unitary developer including the toner only.

Also, the electrophotographic printer can be classified into a mono-color printer and a full-color printer. The mono-color printer uses one toner cartridge of black color, and the color printer uses four toner cartridges of yellow, magenta, cyan, and black colors.

FIG. 1 is a schematic cross-sectional view illustrating a conventional toner cartridge for the dry type electrophotographic printer, and FIG. 2 is a view illustrating a coupled structure of a guide member shown in FIG. 1.

Referring to FIG. 1, the conventional toner cartridge includes a housing 11 including a toner 10 of a predetermined color, a developing roller 13 that develops an image, a supplying roller 15 that supplies the toner 10 to the developing roller 13, and a guide member 17 that is disposed on a lower portion of the supplying roller 15 to guide the toner supply.

The developing roller 13 is separated a predetermined distance from a photosensitive medium 20, and supplies the toner 10 to the photosensitive medium 20 to form the image.

The guide member 17 guides the toner so as to be stably supplied to the developing roller 13, and is installed on the housing 11 through the coupled structure shown in FIG. 2.

Referring to FIG. 2, coupling recesses 17*a* are formed on both ends of the guide member 17, and the housing 11 includes a penetration hole 11*a* for installing the guide member 17 at a predetermined position thereof. The guide member 17 is coupled to the housing 11 using a fixing pin 18. That is, the guide member 17 is disposed so that the coupling recesses 17*a* correspond to the penetration hole 11*a*, and is fixed in the housing 11 by coupling the fixing pin 18 from the external side of the housing 11.

Therefore, since the conventional toner cartridge uses the additional fixing pin to fix the guide member in the housing, the number of elements and fabrication costs increase.

Also, since the assembling process is complex, an error in the coupling position may occur when the guide member is installed. Accordingly, control of the amount of toner supplied to the developing roller may be affected, and the printed image quality may be degraded.

SUMMARY OF THE INVENTION

The present general inventive concept provides a toner cartridge including a guide member having an improved coupling structure.

Additional aspects and advantages of the present general inventive concept will be set forth in part in the description which follows and, in part, will be obvious from the description, or may be learned by practice of the general inventive concept.

The foregoing and/or other aspects and advantages of the present general inventive concept are achieved by providing a toner cartridge including a housing, in which a toner of a predetermined color is filled, including a first coupling portion and a second coupling portion that are formed on predetermined positions of an inner wall of the housing; a developing roller, a part of which is exposed outside of the housing, installed rotatably on the housing to supply the toner to a photosensitive medium and develop an image; a supplying roller that attaches the toner onto the developing roller; and a guide member that guides the toner supply and is coupled to the first and second coupling portions. Both ends of the guide member are coupled to the first and second coupling portions in a state where the guide member is bent so that is can be installed in the housing.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
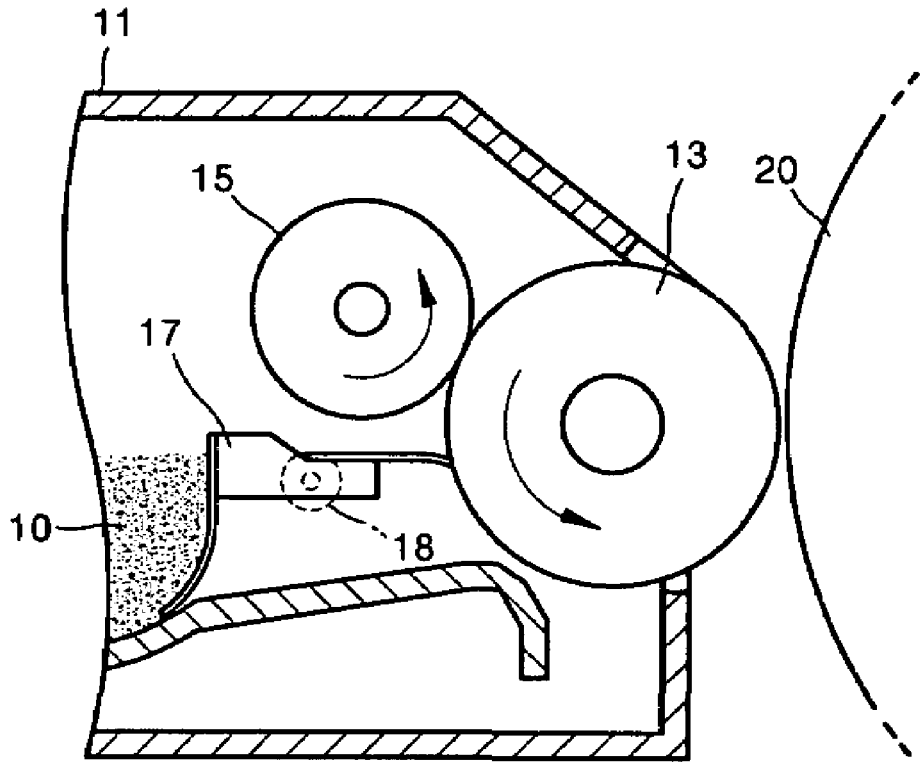
FIG. 1 (PRIOR ART)
FIG. 1 is a cross-sectional view of a toner cartridge of a dry type electrophotographic printer according to the conventional art.
Figure 2:
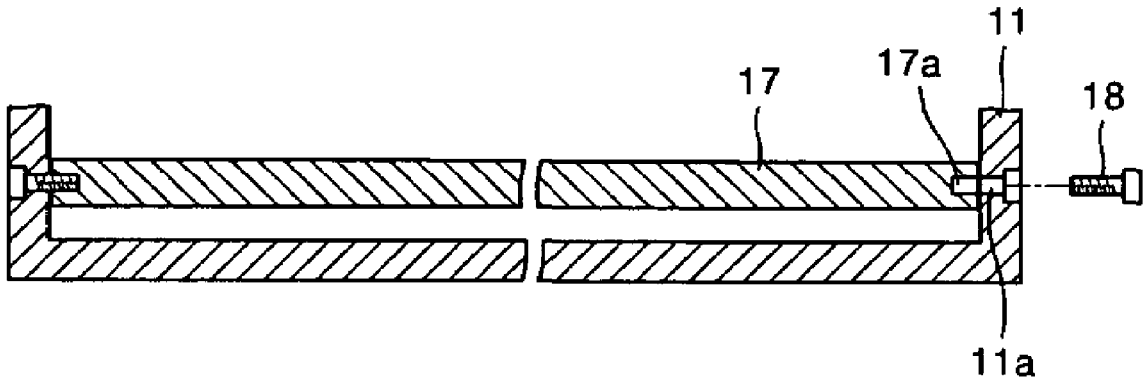
FIG. 2 (PRIOR ART)
FIG. 2 is a schematic cross-sectional view of a coupling structure of a guide member shown in FIG. 1.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

Figure 3:
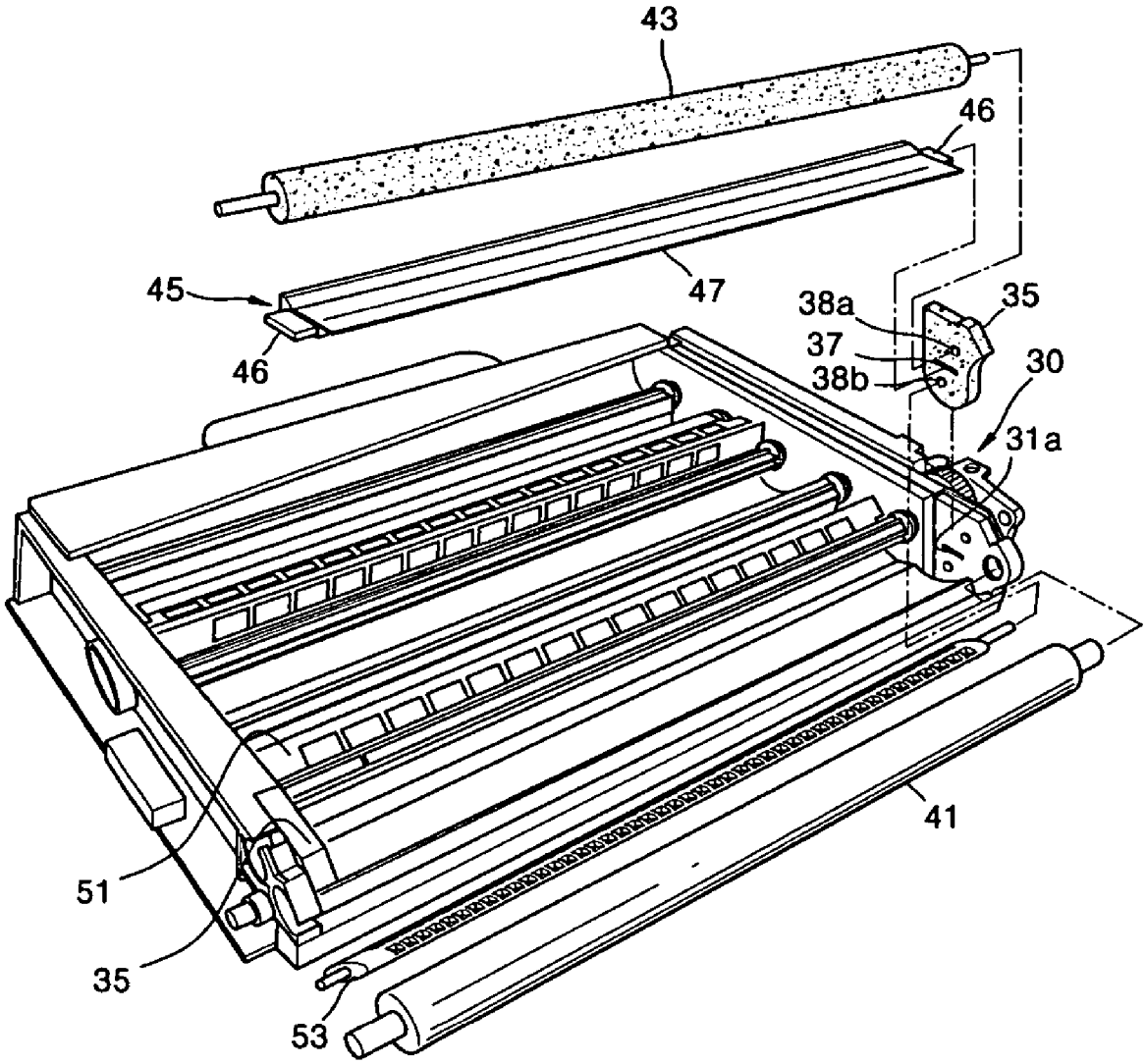
FIG. 3 is a perspective view of a toner cartridge according to an embodiment of the present general inventive concept.
Figure 4:
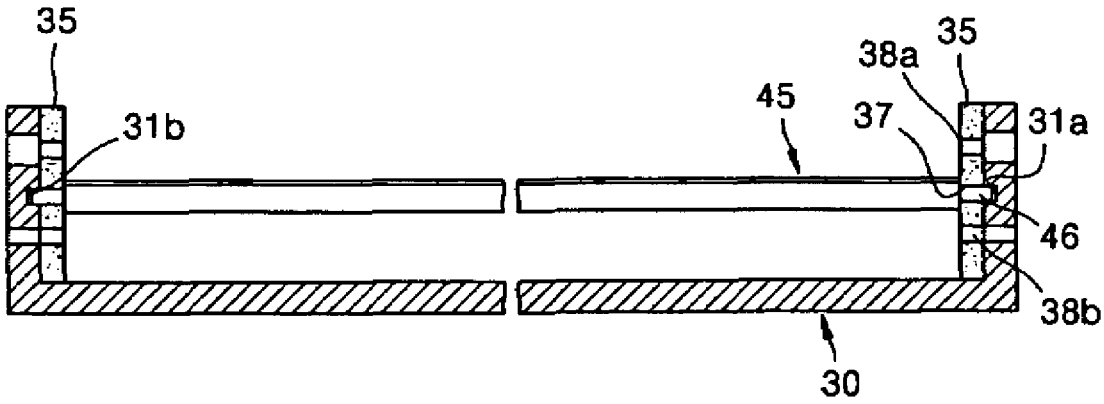
FIG. 4 is a cross-sectional view of a coupling structure of a guide member shown in FIG. 3.

Referring to FIGS. 3 and 4, a toner cartridge according to an embodiment of the present general inventive concept includes a housing 30, a developing roller 41 installed on the housing 30, a supplying roller 43, and a guide member 45.

The developing roller 41 is rotatably installed on the housing 30 such that a certain surface is exposed outside of the housing 30. The developing roller 41 supplies the toner to a photosensitive medium (not shown) and develops an image using an electric potential difference between the developing roller and the photosensitive medium.

The housing 30 includes an inner space where the toner of a predetermined color is filled. Here, an agitator 51 and a recovery member 53 are installed in the inner space of the housing 30. The agitator 51 rotates to transmit the filled toner and the recovery member 53 collects the remaining toner. The housing 30 includes a first coupling portion 31*a* and a second coupling portion 31*b*, on which the guide member 45 is installed, on inner sides thereof. The first and second coupling portions 31*a* and 31*b* can be coupling recesses that are formed in the inner walls of the housing 30.

It is an aspect of the general inventive concept that the housing 30 may further include a pair of buffer members 35 that are installed on the inner walls of the housing at coupling positions of the guide member 45. The buffer members 35 may be in the form of sponge-like structures. Each of the buffer members 35 can be installed on a respective inner wall at the coupling position of the guide member 45, and first coupling openings 37 can be formed at positions corresponding to the first and second coupling portions 31*a* and 31*b*. Also, each buffer member 35 may include second and third coupling openings 38*a* and 38*b*, respectively, to which the supplying roller 43 and the recovery member 53 may be coupled.

The guide member 45 guides the toner that is transmitted by the agitator 51 so as to be supplied to the supplying roller 43 and the developing roller 41. The guide member 45 includes coupling protrusions 46 that protrude from the sides thereof so as to be inserted into the coupling openings 37 and the first and second coupling portions 31*a* and 31*b*. Also, it is desirable that the guide member 45 further includes a controlling blade 47 that is coupled on an upper surface thereof so as to control the toner supplying path. Both ends of the guide member 45 can be inserted into the coupling recesses of the first and second coupling portions 31*a* and 31*b* directly via the above coupling protrusions 46.

It is an aspect of the general inventive concept that the guide member 45 is manufactured using synthetic resin having a predetermined elastic force so that the guide member 45 returns to its original position when an applied external pressure is released.

Figure 5:
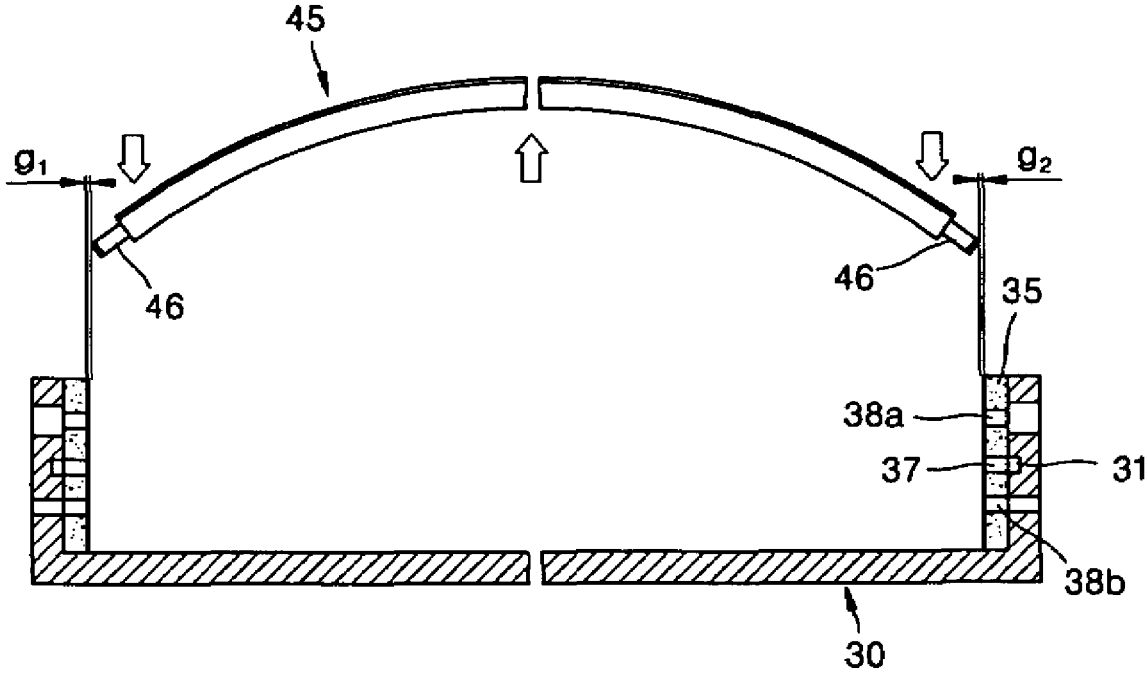
FIG. 5 is a view of a coupling operation of the guide member for a housing shown in FIG. 3.

Therefore, as shown in FIG. 5, when the guide member 45 is installed on the housing 30, the guide member 45 may be bent by pushing the guide member 45 toward the direction of the arrow in FIG. 5. Here, gaps $g_1$ and $g_2$ may be formed as shown in FIG. 5. Then, when the coupling protrusions 46 are positioned at the coupling openings 37 and the first and second coupling portions 31*a* and 31*b* and the applied pressure is released, the guide member 45 returns to its original position, as shown in FIG. 4, and the coupling procedure is complete.

In the above described embodiment, the first and second coupling portions 31*a* and 31*b* are formed as recesses, however, shapes of the first and second coupling portions are not limited to the recessed shape. Further, only one of the first and second coupling portions 31*a* and 31*b* can be formed as a recess.

A toner cartridge according to another embodiment of the present general inventive concept is characteristic in that the structure of first and second coupling portions 31*a* and 31*b* and a guide member are modified as compared to the previous embodiment of the present general inventive concept. Thus, detailed descriptions of the other elements will be omitted herein.

Figure 6:
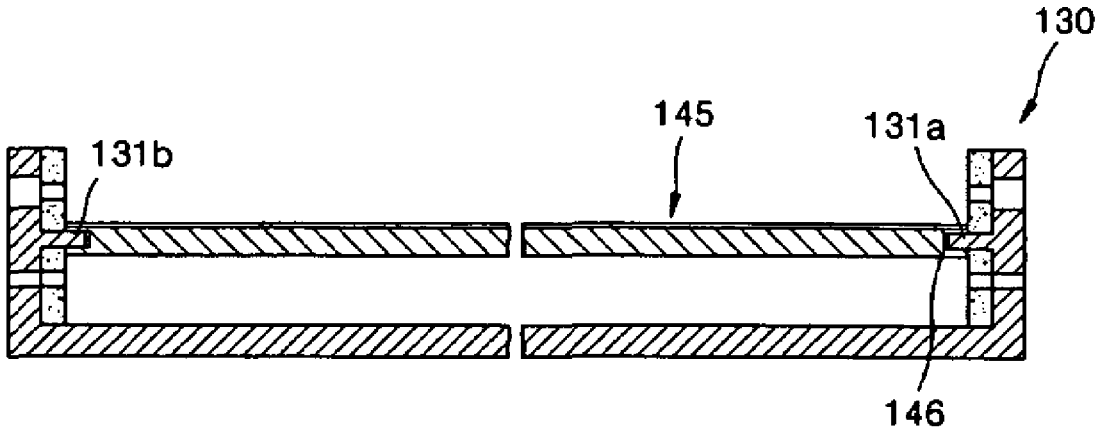
FIG. 6 is a cross-sectional view of a toner cartridge according to another embodiment of the present general inventive concept.

Referring to FIG. 6, a housing 130 according to the present embodiment includes first and second coupling portions 131*a* and 131*b*, on which a guide member 145 is installed on inner walls thereof. Here, the first and second coupling portions 131*a* and 131*b* are coupling protrusions that protrude out from the inner wall of the housing 130. The guide member 145 includes coupling recesses 146 at positions corresponding to the first and second coupling portions 131*a* and 131*b*.

The guide member 145 is installed on the housing 130 in a similar way as shown in FIG. 5. That is, the coupling recesses 146 formed on both sides of the guide member 145 are disposed to face the coupling protrusions of the first and second coupling portions 131*a* and 131*b*, and the guide member 145 can be bent (or flexed) by a pressure applied thereto. When the applied pressure is released from the guide member 45, the guide member 145 returns to its original position such that the first and second coupling portions 131*a* and 131*b* become inserted into the respective coupling recesses 146, and the coupling procedure is completed.

In this embodiment, the first and second coupling portions 131*a* and 131*b* are formed as the protrusions and the guide member 145 includes the coupling recesses, however, this is merely an example. That is, one of the first and second coupling portions 131*a* and 131*b* can be formed as the coupling protrusion, and the guide member 145 can include the coupling recess on one side thereof. It is to be noted that any other similar structure that performs the intended coupling operations as described above may be used as an alternative to those described above.

A toner cartridge according to yet another embodiment of the present general inventive concept has a different structure from those of the previous embodiments with respect to the first and second coupling portions and the guide member coupled to the first and second coupling portions, and thus detailed descriptions for the other elements will be omitted.

Figure 7:
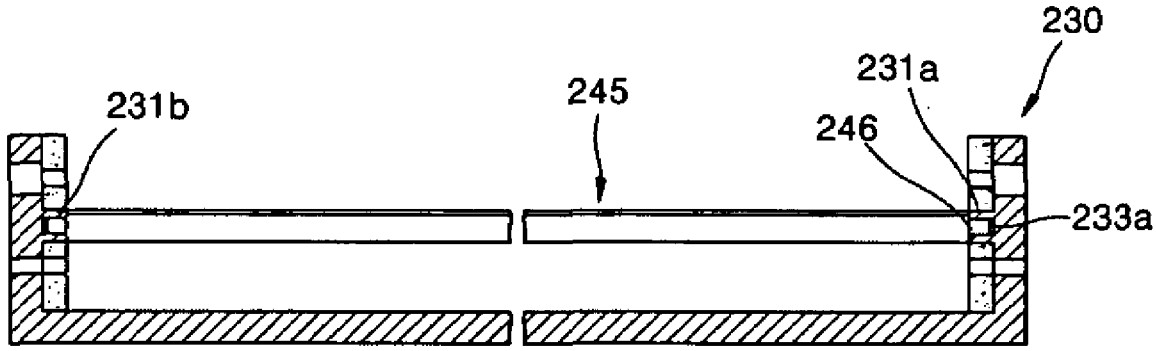
FIG. 7 is a cross-sectional view of a toner cartridge according to another embodiment of the present general inventive concept.

Referring to FIG. 7, a housing 230 according to this embodiment includes a first coupling portion 231*a* and a second coupling portion 231*b*, on which a guide member 245 is installed, on opposite respective inner walls thereof. The first and second coupling portions 231*a* and 231*b* protrude from the respective inner walls of the housing 230, and are formed as coupling guide protrusions having spaces 233*a* therein. The guide member 245 of this embodiment includes coupling protrusions 246 on both sides thereof so that the coupling protrusions 246 are inserted between the space formed between the first and second coupling portions 231*a* and 231*b*. Alternatively, the guide member 245 may not include the coupling protrusions 246, and both ends of the guide member 245 can be inserted in the space between the coupling guide protrusions.

Therefore, the guide member 245 can be installed within the housing 230 in a similar manner as that shown in FIG. 5.

In the above embodiment of FIG. 7, the first and second coupling portions 231*a* and 231*b* may be formed as the coupling guide protrusions having the spaces 233*a* therein, however, the above shapes are merely examples. That is, only one of the first and second coupling portions 231*a* and 231*b* may be formed as the coupling protrusion.

In the toner cartridge constructed as in the above described various embodiments, the guide member can be directly installed on the housing without using an additional fixing pin, thus reducing the steps in a manufacturing process and assembling costs.

Also, since the guide member is directly installed in the housing, the installation position of the guide member can be adjusted accurately, and thus the toner can be supplied stably to the developing roller and the printing quality can be improved.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A toner cartridge comprising:

a housing, in which a toner of a predetermined color is filled, including a first coupling portion and a second coupling portion that are formed on predetermined positions of respective inner walls of the housing;

a developing roller installed rotatably on the housing to supply the toner to a photosensitive medium and develop an image;

a supplying roller that supplies the toner onto the developing roller; and a guide member that guides the toner supply and is fixedly and flexibly coupled between the first and second coupling portions such that the guide member is flexed when being installed in the housing.

2. The toner cartridge of claim 1, wherein the first and/or second coupling portions are coupling recesses formed in the respective inner walls of the housing, and the guide member includes a coupling protrusion that protrudes from at least on one side thereof corresponding to the coupling recesses.

3. The toner cartridge of claim 2, wherein the first and/or second coupling portions are/is the coupling recess of a predetermined size that is formed in the inner wall of the housing so that at least one end of the guide member can be directly coupled to the housing.

4. The toner cartridge of claim 1, wherein the first and/or second coupling portions are/is a coupling protrusion that protrudes from the respective inner wall of the housing, and the guide member includes a coupling recess that is formed in at least one side thereof corresponding to the coupling protrusion.

5. The toner cartridge of claim 1, wherein the first and/or second coupling portion are/is a coupling guide protrusion that protrudes from the respective inner wall of the housing and includes a space, and at least one end of the guide member is directly coupled to a space disposed between the coupling guide protrusions.

6. The toner cartridge of claim 1, wherein the housing further comprises a pair of buffer members each formed on the respective opposing inner wall, and including coupling openings at positions corresponding to the first and second coupling portions.

7. The toner cartridge of claim 1, wherein the guide member is manufactured using a synthetic resin having a predetermined elastic force so that it returns to its original position when an external pressure is released.

8. The toner cartridge of claim 2, wherein shapes of the coupling recesses correspond to a shape of the coupling protrusion.

9. The toner cartridge of claim 4, wherein a shape of the coupling protrusion corresponds to a shape of the coupling recess.

10. The toner cartridge of claim 6, wherein the buffer members comprise a porous material.

11. A toner cartridge comprising:

a housing, in which a toner of a predetermined color is provided, including a coupling recess that is formed at a predetermined position of opposing inner walls of the housing;

a developing roller installed rotatably on the housing to supply the toner to a photosensitive medium and to develop an image;

a supplying roller that supplies the toner onto the developing roller;

a guide member that guides the toner and includes coupling protrusions protruding from both ends thereof to be inserted into the respective coupling recesses; and a pair of buffer members each formed on the respective opposing inner wall, and including a coupling opening, wherein each of the coupling protrusions are coupled to one of the coupling openings such that the guide member is flexed when being fixedly installed in the housing.

12. The toner cartridge of claim 11, wherein the guide member is manufactured using a synthetic resin having a predetermined elastic force so that the guide member returns to an original position when external pressure is released.

13. The toner cartridge of claim 11, wherein shapes of the coupling protrusions of the guide member correspond to shapes of the respective coupling recesses of the housing.

14. The toner cartridge of claim 11, wherein the buffer members comprise a porous material.

15. A toner cartridge comprising:

a housing for toner including a first coupling portion and a second coupling portion formed at opposing inner walls of the housing;

a developing roller installed rotatably at end portions of the inner walls to supply the toner outside of the housing;

a supplying roller that supplies the toner to the developing roller; and a flexible guide member that guides the toner being supplied to the developing roller and is fixedly coupled between the first and second coupling portions by flexing the guide member to couple opposing ends thereof to respective first and second coupling portions.

16. The toner cartridge of claim 15, wherein the flexible guide member comprises a controlling blade coupled to an upper surface of the flexible guide member to control a toner supply path.

17. The toner cartridge of claim 15, wherein the flexible guide member is formed of an elastic material.

18. The toner cartridge of claim 15, wherein the flexible guide member is formed of a synthetic resin.

19. The toner cartridge of claim 15, further comprising buffer members positioned at each of the inner walls of the housing to face each other, each of the buffer members including coupling openings to receive ends of the flexible guide member to couple the flexible guide member within the housing.

20. The toner cartridge of claim 15, further comprising buffer members positioned at each of the inner walls of the housing to face each other, each of the buffer members including coupling portions extending from the buffer members to engage with respective ends of the flexible guide member to couple the flexible guide member within the housing.

21. The toner cartridge of claim 20, wherein the flexible guide member includes an opening at each end thereof to receive the respective coupling portion of the buffer members.

22. The toner cartridge of claim 15, wherein shapes of the first and second coupling portions correspond to shapes of the opposing ends of the guide member.

23. A method of attaching a toner guide member within a toner cartridge apparatus, the method comprising:

flexing the toner guide member; and fixedly-coupling opposing ends of the toner guide member to respective opposing inner walls of the toner cartridge.

24. The method of claim 23, further comprising inserting the opposing ends of the toner guide member into coupling openings of the respective opposing inner walls of the toner cartridge.

25. The method of claim 23, further comprising inserting coupling portions extending from each of the inner opposing walls of the toner cartridge into respective corresponding coupling recesses formed within the ends of the toner guide member.

26. The method of claim 24, wherein shapes of the opposing ends of the toner guide member correspond to shapes of the respective coupling openings of the toner cartridge.

27. The method of claim 25, wherein shapes of the coupling portions extending from each of the inner opposing walls of the toner cartridge correspond to shapes of the respective coupling recesses formed within the ends of the toner guide member.

* * * * *